US007386955B1

(12) United States Patent
Repasky

(10) Patent No.: US 7,386,955 B1
(45) Date of Patent: Jun. 17, 2008

(54) STACKABLE PEDESTAL FOR SUPPORTING DECKING ELEMENTS

(76) Inventor: John Repasky, 294 Bender Rd., Hanover, PA (US) 17331

( * ) Notice: Subject to any disclaimer, the term of this patent is extended or adjusted under 35 U.S.C. 154(b) by 0 days.

(21) Appl. No.: 11/559,055

(22) Filed: Nov. 13, 2006

(51) Int. Cl.
*E04B 5/00* (2006.01)

(52) U.S. Cl. ..... 52/126.6; 52/105; 52/263; 248/188.4

(58) Field of Classification Search ..... 52/263, 52/126.6, 126.1, 126.4, 126.5, 126.7, 220.1, 52/220.2, 220.3, 220.5; 248/188
See application file for complete search history.

(56) References Cited

U.S. PATENT DOCUMENTS 4,506,483 A * 3/1985 Phalen, Jr. ..... 52/408
4,570,397 A 2/1986 Creske
4,922,670 A * 5/1990 Naka et al. ..... 52/126.6
4,996,804 A * 3/1991 Naka et al. ..... 52/126.6
5,072,557 A * 12/1991 Naka et al. ..... 52/126.6
5,333,423 A * 8/1994 Propst ..... 52/126.6
5,377,468 A 1/1995 Repasky
5,442,882 A 8/1995 Repasky
5,588,264 A 12/1996 Buzon
5,887,397 A 3/1999 Repasky
6,332,292 B1 12/2001 Buzon
6,370,831 B1 * 4/2002 Marshall et al. ..... 52/263
6,508,037 B1 * 1/2003 Owen ..... 52/220.1
6,604,330 B2 8/2003 Repasky

OTHER PUBLICATIONS

Envirospec Inc., "PAVE-EL Paver-Stone Pedestals Specifications", pp. 1-6, Sep. 18, 2006.
Bison, "Bison Deck Supports—Parts & Accessories", p. 1, Sep. 18, 2006.
Wegu, "Terring—Paving Slab Support System", 2 pages, Sep. 18, 2006.

* cited by examiner

*Primary Examiner*—Richard E. Chilcot, Jr.
*Assistant Examiner*—Mark R Wendell
(74) *Attorney, Agent, or Firm*—Howson & Howson LLP

(57) ABSTRACT

A pedestal is provided that is matingly engagable with a like companion pedestal in vertically stacked relation to support corner portions of pavers, tiles, or like decking elements in edgewise juxtaposition above an underlying surface. The pedestal has a base, plate, or body, having a plurality of corner support portions and a topside and bottom side that define a predetermined thickness, or height, of the base, plate, or body. An abutment, such as an upstanding wall, flange, post, or the like, projects upwardly from the topside a predetermined distance, or height, that is greater than or equal to the predetermined thickness of the base, plate, or body. An aperture, such as a slot or the like, extends transversely through the base, plate, or body and is offset from the abutment. Accordingly, a like abutment of a companion pedestal can extend through the aperture of an upper stacked pedestal thereby permitting the pedestals to be stacked together in a stable manner.

19 Claims, 4 Drawing Sheets

FIG.1
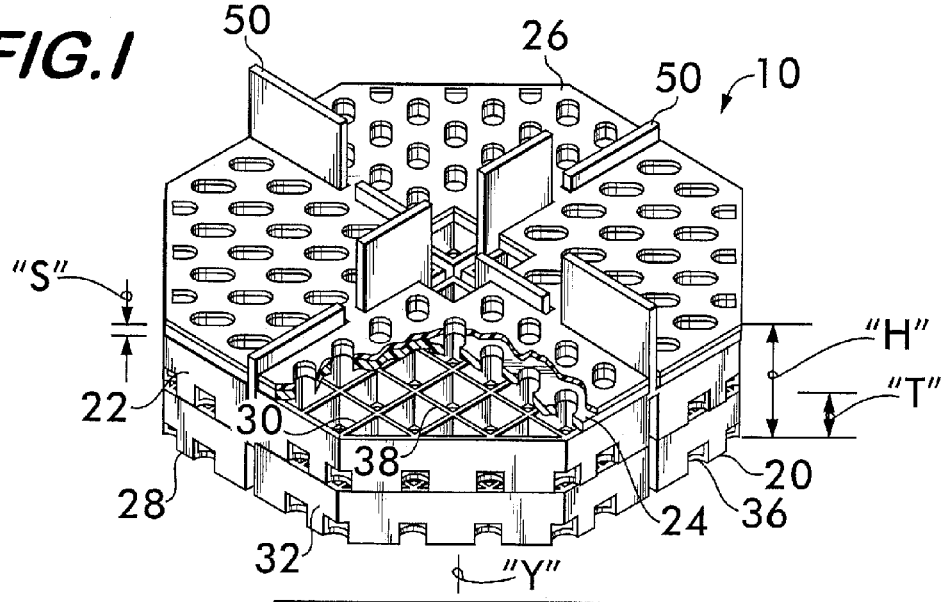
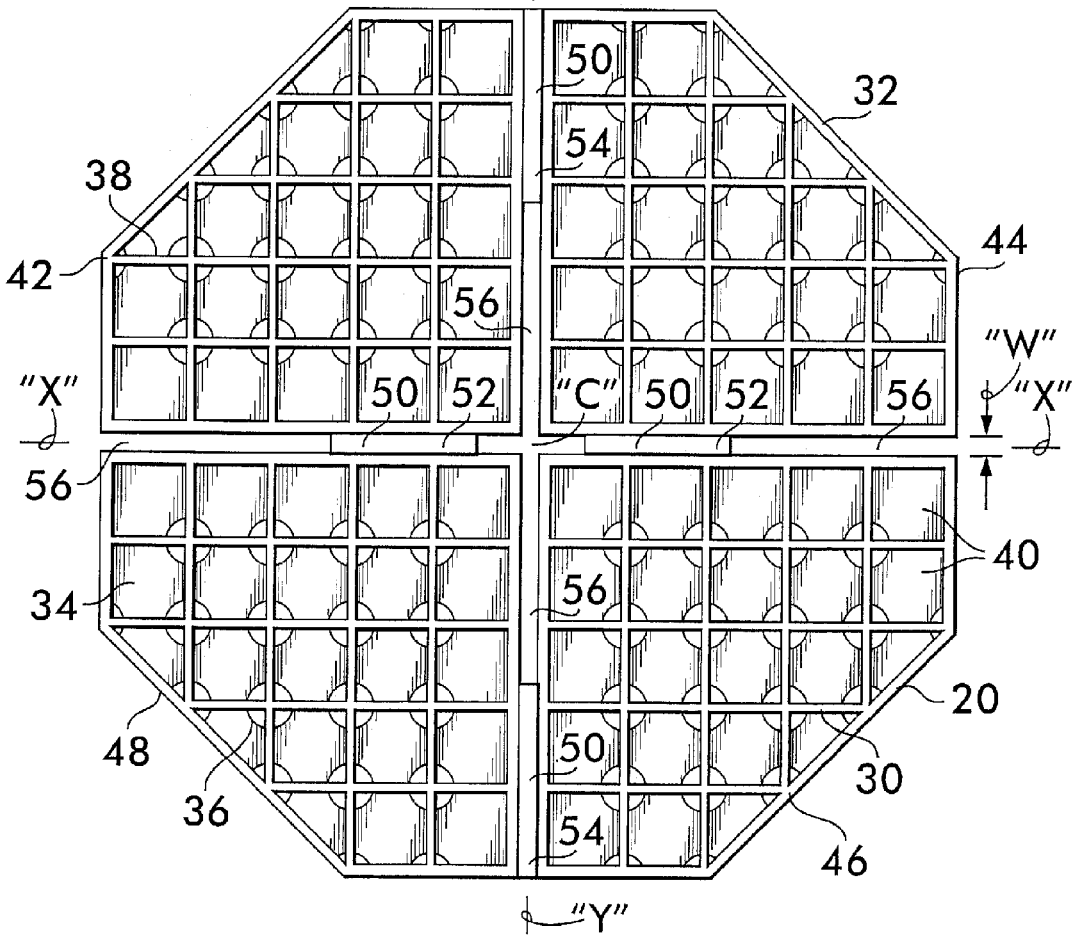
FIG.3

STACKABLE PEDESTAL FOR SUPPORTING DECKING ELEMENTS

BACKGROUND OF THE INVENTION

The present invention relates generally to systems and pedestals for constructing a traffic-bearing surface elevated from an underlying surface, and more particularly, the present invention relates to a stackable pedestal, such as a fixed height pedestal, and deck system using same.

Decking systems can be used to construct terraces, pedestrian walkways, gardens, plaza decks, sun decks, balconies, patios or the like elevated from an underlying surface or structure. Such decking systems may be elevated for drainage or other purposes and can be constructed on horizontal as well as inclined underlying surfaces. For example, inclined roofs of many buildings are capable of supporting a traffic-bearing surface, or deck.

Examples of deck systems utilizing roof pavers, or ballast blocks, are disclosed in U.S. Pat. Nos. 5,887,397; 5,377,468; 5,442,882; and 6,604,330 B2 issued to Repasky. Also see U.S. Pat. Nos. 4,570,397 issued to Creske; and 5,588,264 and 6,332,292 B1 issued to Buzon.

So-called "fixed-height" pedestals are disclosed in U.S. Pat. Nos. 5,442,882 and 6,604,330 B2 issued to Repasky. For example, a fixed-height pedestal (reference numeral 30) is illustrated in the Repasky '882 patent, and a fixed-height pedestal (reference numeral 68) is illustrated in the Repasky '330 patent. The fixed height pedestals have upstanding walls that define quadrants on which the corner portions of pavers or the like are supported. The upstanding walls engage the edges of the pavers to hold the pavers in a desired position and create desired uniform lateral spacing between adjacent pavers so that drainage gaps are provided.

The above referenced fixed-height pedestals are stackable. For this to be possible, the upstanding walls on a lower pedestal are received within downwardly-opening recesses formed on an underside of an upper pedestal. Accordingly, if the upper and lower pedestals are identical and of identical thickness, the height of the upstanding walls is limited to a height slightly less then the thickness of the fixed height pedestal body.

Further, it is known to use relatively-thin, flat shims to refine the height of a pedestal assembly. Typically, the flat shims are of a thickness less than the thickness of the fixed height pedestal body and have openings permitting the shims to fit over the upstanding walls of the pedestal. As an example, if the height, or thickness, of a fixed-height pedestal is about 0.625 inch (1.6 cm), flat shims with a thickness of 0.125 inch (0.3 cm) or 0.0625 inch (0.16 cm) may be added onto the pedestal to make fine adjustments to the total height of the pedestal assembly. However, the addition of the shims effectively reduces the height to which the upstanding walls extend above the upper surface of the pedestal assembly. Reducing the height of the upstanding wall of the pedestal assembly causes problems in that the pavers can be easily jostled out of proper position and alignment.

While the deck systems disclosed in the above referenced patents may be satisfactory for their intended purposes, there is a need for a stable, stackable pedestal for use in such systems. The system should ensure that the pedestal assembly retains the pavers, tiles, or other like decking elements in a desired position within a deck and should permit the height of the pedestal to be adjusted by stacking like pedestals together and by the addition of shims to the top of the pedestal assembly. In addition, the pedestals should be capable of efficient manufacture and installation.

SUMMARY OF THE INVENTION

More specifically, the present invention provides a pedestal matingly engagable with a like companion pedestal in vertically stacked relation to support corner portions of pavers, tiles, or like decking elements in edgewise juxtaposition above an underlying surface. The pedestal has a base, plate, or body, having a plurality of corner support portions. The base, plate, or body has a topside and a bottom side that define a predetermined thickness, or height, of the base, plate, or body. An abutment, such as an upstanding wall, flange, post, or the like, projects upwardly from the topside a predetermined distance, or height, that is greater than or equal to the predetermined thickness of the base, plate, or body. An aperture, such as a slot or the like, extends transversely through the base, plate, or body and is offset from the abutment. Accordingly, a like abutment of a companion pedestal can extend through the aperture of an upper stacked pedestal thereby permitting the pedestals to be stacked together in a stable manner.

According to another aspect of the present invention, a deck system for forming an elevated surface is provided. The deck system includes a plurality of pavers, tiles, or separate decking elements disposed in edgewise juxtaposition to form a deck. Each of the pavers, tiles or decking elements has corner portions, and the deck includes intersection areas in which the corner portions of adjacent pavers, tiles or decking elements are supported by pedestals positioned directly beneath the intersection areas. The pedestals support the corner portions a spaced distance above an underlying surface and include one or more fixed height base plates having a topside and a bottom side defining a predetermined fixed height therebetween. The base plate has abutments projecting upwardly from the topside a predetermined distance that is greater than or equal to the predetermined fixed height of the base plate. In addition, the base plate has apertures extending transversely therethrough for receiving like abutments of an identical fixed height base plate when the base plates are stacked together.

BRIEF DESCRIPTION OF THE DRAWINGS

The features and advantages of the present invention should become apparent from the following description when taken in conjunction with the accompanying drawings, in which:

FIG. 1 is a perspective view of a pedestal assembly embodying the present invention;

FIG. 3 is a top plan view of a stackable, fixed-height pedestal according to the present invention;

DETAILED DESCRIPTION OF THE PRESENT INVENTION

Figure 5:
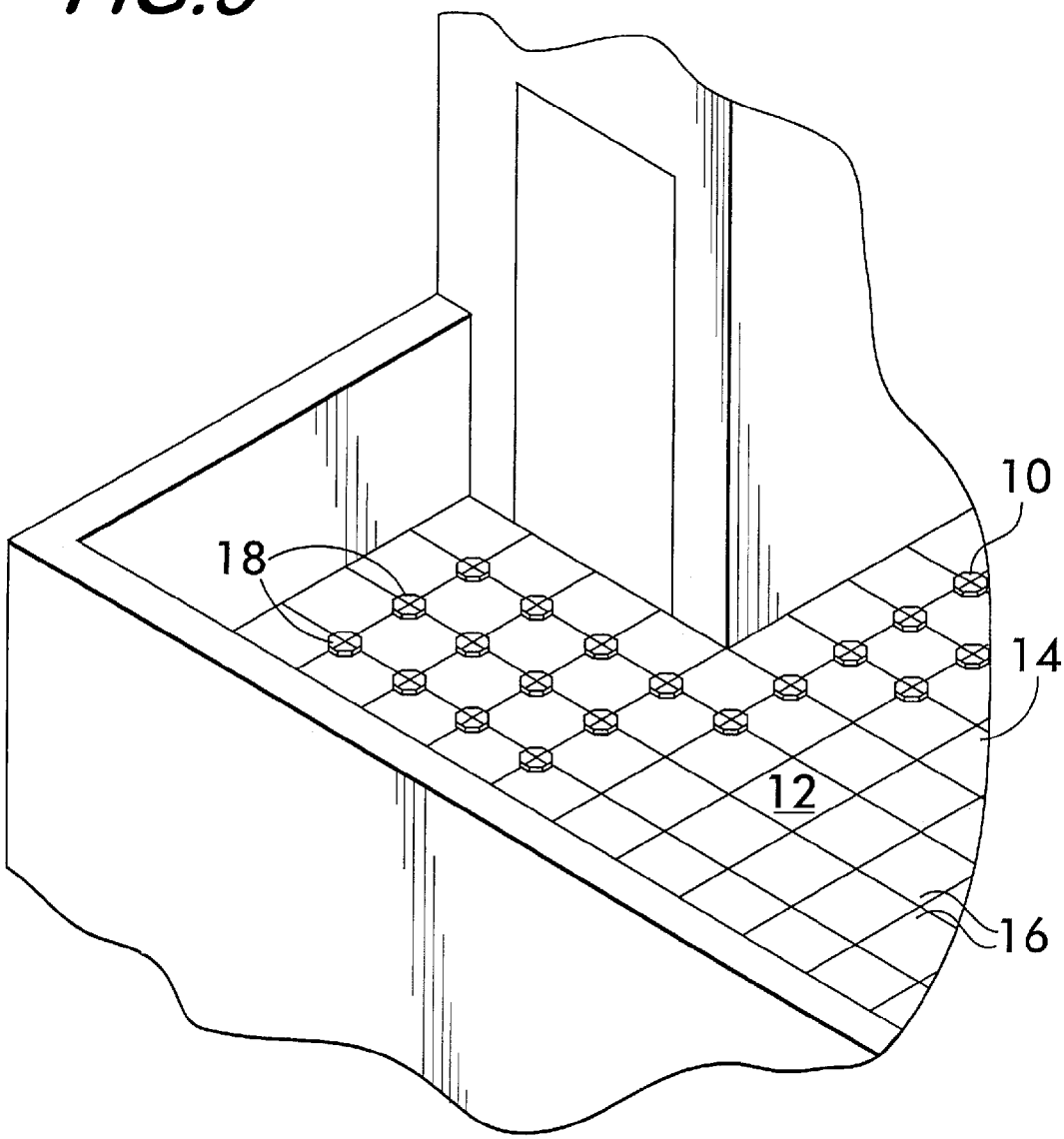
FIG. 5 is a deck according to the present invention.

As best illustrated in FIG. 5, a deck 14 according to the present invention is typically constructed of a plurality of separate, substantially-rectangular decking elements 12, including pavers, ballast blocks, tiles, panels, or like separate elements (hereinafter referred to as decking elements) that are arranged in a grid layout, or pattern, and that are supported a spaced distance above an underlying surface. The deck 14 can provide a substantially level traffic-bearing surface for pedestrians and can be used to convert an otherwise unusable space into a useful area. Examples of decks made of decking elements are disclosed in U.S. Pat. Nos. 5,442,882 and 6,604,330 B2 issued to Repasky, the disclosures of which are incorporated herein by reference.

Each separate decking element 12 can be made of concrete, marble, granite, wood, rubber, plastic, composite materials, or like weight-bearing substance and is typically square, rectangle, or some other shape in plan that can be readily positioned in a substantially uniform pattern. Accordingly, each decking element 12 will typically have corner portions 16, and the deck 14 will include intersection areas 18 in which corner portions 16 of adjacent decking elements 12 are arranged in edgewise juxtaposition.

A separate pedestal assembly 10 underlies each intersection area 18 of the deck 14 and supports the corner portions 16 of adjacent decking elements 12, such as four corner portions of four adjacent decking elements. See FIG. 5. Thus, the deck 14 is elevated from an underlying surface by the pedestal assemblies 10. Preferably, the pedestal assemblies 10 also ensure proper lateral spacing between adjacent decking elements 12 so that the deck 14 permits drainage of fluids, such as rain, therethrough.

Figure 2:
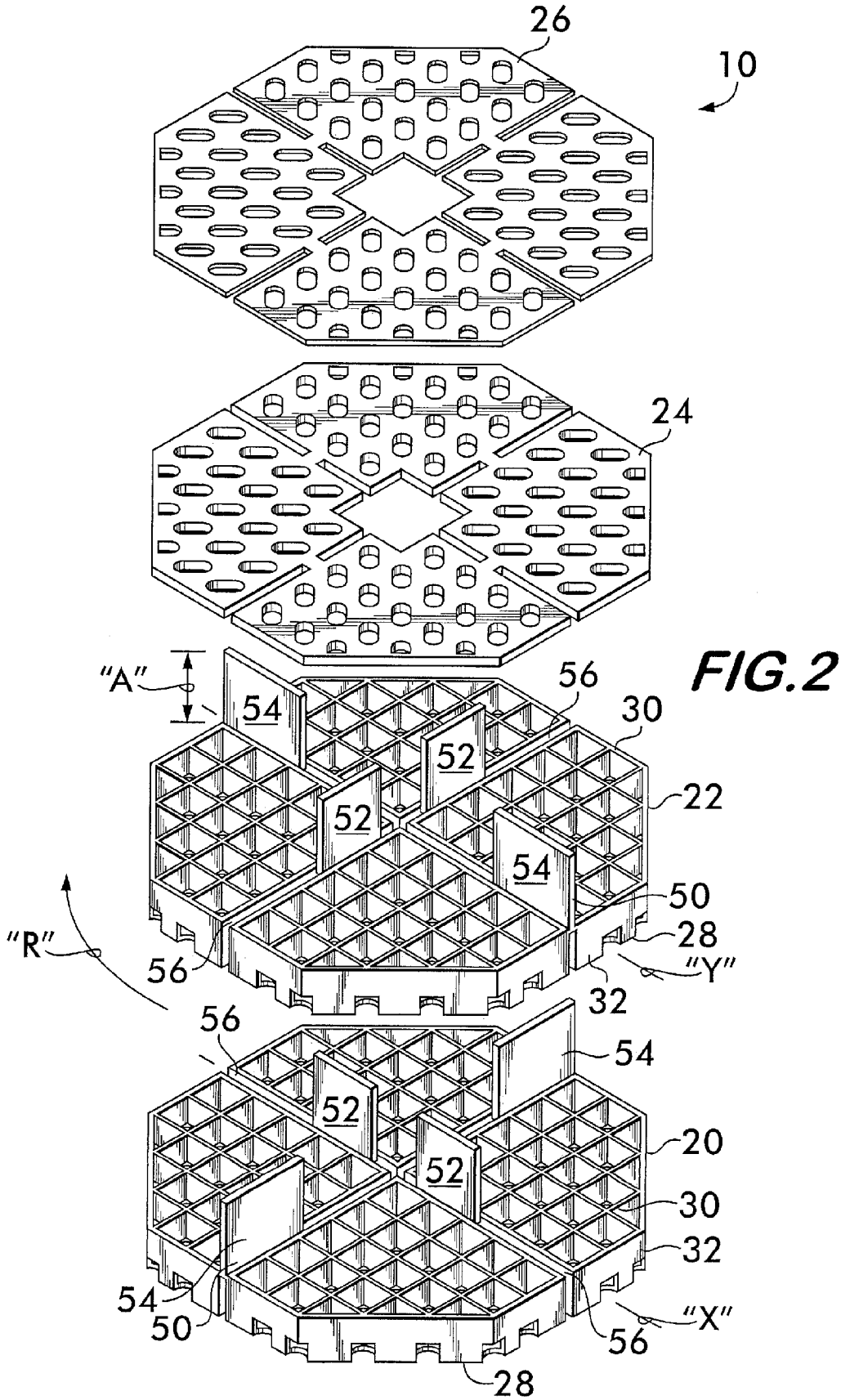
FIG. 2 is an exploded perspective view of the pedestal assembly of FIG. 1.

An example of a pedestal assembly 10 according to the present invention is illustrated in FIGS. 1 and 2. In this example, the pedestal assembly 10 includes a fixed height pedestal plate, body, or base 20 on which an identical fixed height pedestal plate, body, or base 22 is stacked. First and second height adjustment shims, 24 and 26, are stacked on the upper pedestal plate 22 thereby providing the pedestal assembly 10 with an overall height "H". Of course other pedestal assemblies may include only a single pedestal plate or three or more pedestal plates stacked together. In addition, the pedestal assembly can include one or more shims of the same or different thicknesses or no shims. For some examples, see FIG. 4.

The pedestal plate 20 is typically an integral, molded, plastic or rubber body. For example, the pedestal plate 20 may be molded of rubber or injection molded of polypropylene, polyethylene, or like thermoplastic material. As best illustrated in FIGS. 1-3, the pedestal plate 20 includes a bottom side 28, topside or surface 30, and a peripheral sidewall 32. The pedestal plate 20 can have an openwork structure as illustrated in FIGS. 1-3 for purposes of reducing material costs, or alternatively, can be substantially solid.

In the illustrated embodiment, the openwork structure of pedestal plate 20 has a pan-shaped configuration defined by a relatively thin base wall 34 from which the sidewall 32 projects. The sidewall 32 provides the pedestal plate 20 with an octagonal periphery in plan. See FIG. 3. Of course, the periphery could also be circular, oval, square, rectangular, hexagonal, or any other shape. Drainage openings 36 are formed in both the base wall 34 and the sidewall 32 to permit rain and other fluids to pass therethrough to an underlying surface or structure. The remaining body portion of the pedestal plate 20 is formed from a network of inner walls 38 projecting from the base wall 34 and extending within the sidewall 32 in a crosswise, or grid-like, pattern forming a plurality of vertically-oriented openings 40 in a honeycomb like manner. The openings 40 permit the plate to be lightweight and produced from a minimum of plastic; while, the network of walls 38 provide sufficient strength to enable the pedestal plate 20 to support relatively heavy decking elements 12, such as ballast blocks.

The upper edges of the inner walls 38 and sidewall 32 form the topside 30 of the pedestal plate 20 and define a surface on which a like pedestal 22, shims 24 and 26, or decking elements 12 can be supported. The thickness, or fixed height, "T" of pedestal plate 20 is defined by the distance from the bottom side 28 to the topside 30. The thickness "T" of pedestal plates 20 and 22 are identical. The thickness "S" of the shims is less than the thickness "T" of the pedestal plate 20 and is intended to permit fine incremental adjustments to the overall height "H" of the pedestal assembly 10.

By way of example, and not by way of limitation, the pedestal plates 20 and 22 can be identical and each have a thickness "T" of about 0.625 inch (1.6 cm). The larger shim 24 can have a thickness "S" of 0.125 inch (0.3 cm), and the thickness of the thinner shim 26 can be 0.0625 inch (0.16 cm). Thus, the combination can provide an overall pedestal assembly height "H" of about 1.44 inches (3.65 cm). Of course, this is just an example and other pedestal plates and shims of greater or lesser thicknesses and different combinations of plates and/or shims can be utilized.

As best illustrated in FIG. 3, the pedestal plate 20 includes a plurality of corner support portions 42, 44, 46 and 48, thereby defining four separate quadrants. Of course fewer or more corner support portions can be provided by the pedestal. In the illustrated example, four corner portions 16 of four separate decking elements 12 will be supported on the pedestal assembly 10 such that one corner portion 16 is supported above each corner support portion, 42, 44, 46 and 48, on the pedestal plate 20 or on a like pedestal plate 22 or shim 24 or 26 positioned intermediate of the pedestal plate 20 and the decking element 12.

A first axis, or line of position, "X" and a second axis, or line of position "Y" are illustrated in FIG. 3 and define the boundaries of the corner support portions 42, 44, 46, and 48 on the pedestal plate 20. In the illustrated embodiment, the first axis, or line of position, "X" is disposed perpendicular, or orthogonal, to the second axis, or line of position "Y".

According to the present invention, at least one upstanding abutment 50 projects upwardly from the topside 30 of the pedestal plate 20. The abutment 50 extends within a first imaginary plane extending vertically through the pedestal plate 20 and axis "X" or within a second imaginary plane extending vertically through axis "Y". Accordingly, the abutment 50 extends between the boundaries of adjacent quadrants. Preferably, at least one abutment 50 extends between each pair of adjacent quadrants. Thus, as illustrated in FIG. 2, each pedestal plate 20 and 22 has four separate abutments 50 in a crosswise pattern.

The abutments 50 provide surfaces that engage edges of corner portions 16 of the decking elements 12 and define the location and proper position of each decking element 12 within the deck 14. Further, the width "W" of the abutments 50 determine lateral spacing between adjacent decking elements 12 thereby defining drainage gaps between the decking elements 12. The abutments 50 located on the top of the pedestal assembly 10 must extend to a height that affords a proper amount of engagement between the abutment 50 and the edges of the decking elements 12 sufficient to prevent decking elements from being readily jostled out of proper position past or over the abutments 50. However, the height of the abutment 50 should be less then the thickness of the decking element 12 to ensure that the abutment does not extend above the surface of the deck 14.

By way of example, and not by way of limitation, a pedestal plate 20 that has a thickness "T" of 0.652 inch (1.6 cm) can have an abutment 50 of a height "A" of about 0.652 inch (1.6 cm) to about 1.0 inch (2.54 cm) or more. Accordingly, the abutments 50 are preferably of a height "A" that is greater than or equal to the thickness "T" of the pedestal plate 20.

In the illustrated embodiments, the abutments 50 are provided as solid walls or flanges formed integrally with the pedestal plates 20 and 22. Alternatively, the abutments 50 can be provided by as a post, tab, or an array of like elements. The pedestal plate 20 and 22 include one abutment 50 between each of the quadrants for a total of four abutments 50 per plate. The illustrated arrangement of the abutments 50 include a first pair of abutments 52 on the "X" axis that is located close to a center "C" of the pedestal plate 20 and a second pair of abutments 54 on the "Y" axis that are spaced further from the center "C". Thus, the spacing between the first pair of abutments 52 is different than the spacing between the second pair of abutments 54. The significance of this arrangement is discussed in greater detail below.

The pedestal plate 20 has one or more apertures 56 that extend transversely through the plate and that opens in both the topside 30 and bottom side 28. Each aperture 56 is sized to accommodate and receive at least one abutment 50 extending from a lower-positioned pedestal plate within a stack of pedestal plates. For example, the apertures 56 in pedestal plate 22 receive the abutments 50 extending from pedestal plate 20. Accordingly, the apertures 56 permit the bottom side 28 of the pedestal plate 22 to be seated flush on the top side 30 of the pedestal plate 20. See FIG. 1. In addition, since the height "A" of the abutment 50 extending from pedestal plate 20 is greater than or equal to the thickness "T" of pedestal plate 22, the abutment 50 from the pedestal plate 20 can extend to height above the top side 30 of pedestal plate 22, if desired. See FIG. 1.

The apertures 56 of pedestal plate 20 are located on the "X" and "Y" lines of position between the corner support portions, 42, 42, 46 and 48, and are offset from the abutments 50 that extend from pedestal plate 20. Accordingly, preferably an abutment 50 and an aperture 56 are located between each adjacent pair of corner support portions, 42, 42, 46 and 48. In FIG. 3, the apertures 56 are spaced outwardly of the abutments 52 and inwardly of the abutments 54 and are provided as elongate open slots. Accordingly, when pedestal plate 22 is turned about a quarter turn relative to pedestal plate 20 (see arrow "R" in FIG. 2) and the first line of position "X" of pedestal plate 20 is aligned with the second line of position "Y" of pedestal plate 22, the abutments 50 of the pedestal plate 20 are aligned with and capable of being received within the apertures 56 of pedestal plate 22. Additional identical pedestal plates can be stacked on these plates, as desired.

An advantage of this arrangement is that the abutments 50 extending from the upper pedestal plate 22 will always be of a significant height despite the addition of shims. As stated previously, the addition of shims, 24 and 26, reduces the height to which the abutments 50 of plate 22 extend above a top surface of the pedestal assembly 10. However, since abutments 50 are of height "A" greater than or equal to the thickness "T" of each pedestal plate, 20 and 22, any amount of shims can be used and the abutments 50 will still be of a sufficient height. Of course, when the total thickness of the shims, 24 and 26, matches the thickness "T" of a pedestal plate, the shims can be removed and replaced with a pedestal plate providing a new set of abutments 50.

Figure 4:
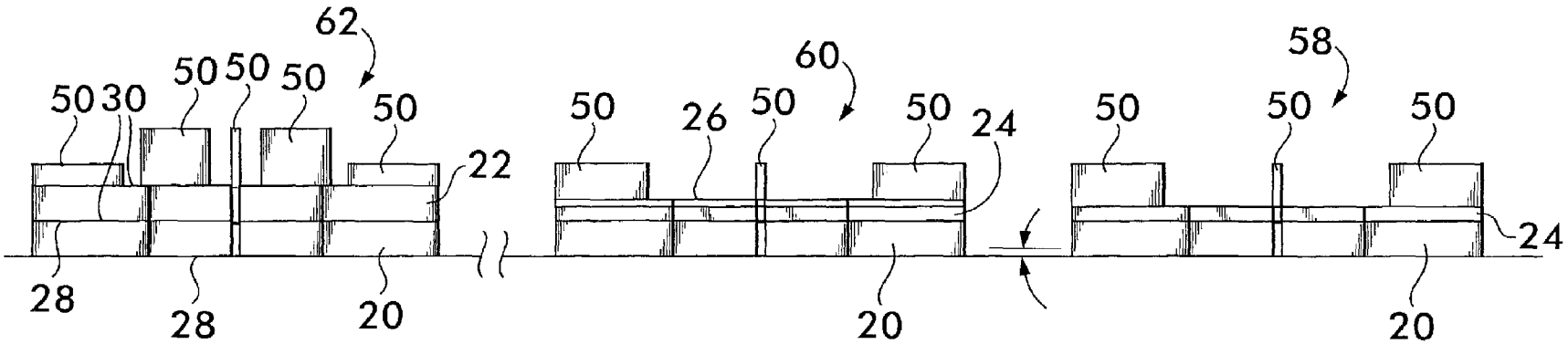
FIG. 4 is a elevational view of a part of a deck system according to the present invention supported on an underlying uneven surface.

FIG. 4 illustrates the stacking capability of the pedestal plates 20 and 22 and shims 24 and 26. For example, pedestal assembly 58 includes pedestal plate 20 and shim 24. The abutments 50 extend a sufficient height above the top surface of the pedestal assembly 58 to engage the edges of decking elements in an effective manner. Pedestal assembly 60 includes pedestal plate 20 with shims 24 and 26, and the abutments 50 still extend a sufficient height above the shims to be effective. Pedestal assembly 62 includes pedestal plates 20 and 22 with the full height of the abutments 50 of pedestal plate 22 being exposed. Thus, the stackable pedestal assemblies can be used on level underlying surfaces, uneven underlying surfaces, inclined or sloped underlying surfaces or with deck elements of inconsistent thickness.

As an example, a possible location of the deck 14 is on a sloped underlying surface provided by the roof of a building or other structure. Such surfaces may be provided at a slope for drainage or other purposes. In this case, levelers (not shown) can be used between the underlying surface and pedestal assemblies 10 to ensure that the pedestal assemblies 10 project substantially parallel to a vertical direction. As an example, the levelers can be those disclosed in U.S. Pat. No. 5,442,882 issued to Repasky, the disclosure of which is herein incorporated by reference.

It may be desired in some installations that the decking elements 12 be mechanically secured to the pedestal assemblies 10. In this case, a corner cap (not shown) can extend over the corner portions 16 of the decking elements 12 within an intersection area 18 and be mechanically tied to the pedestal assembly 10 with a fastener or the like. As an example, the caps can be those disclosed in U.S. Pat. No. 6,604,330 B2 issued to Repasky, the disclosure of which is herein incorporated by reference.

The above-described deck system and pedestal assembly according to the present invention provides a stable elevated traffic bearing surface for pedestrians and the like on an existing structure or surface. The pedestal assemblies and deck are easy to install and inexpensive to manufacture. The height of each pedestal assembly can be adjusted by adding further identical pedestal plates to the assembly or by adding shims for fine height adjustments. Each pedestal plate is identical and permits stacking when positioned one quarter turn relative to an underlying pedestal plate. Although fixed height pedestal plates have been described, the present invention can also be utilized on non-fixed height pedestals. In addition, preferably each pedestal plate can be broken in half for placement along walls and can be broken into quarters for placement in corners.

While preferred deck system and pedestal assemblies have been described in detail, various modifications, alterations, and changes may be made without departing from the spirit and scope of the deck system and pedestal assembly according to the present invention as defined in the appended claims.

The invention claimed is:

1. A pedestal assembly for supporting corner portions of decking elements, in edgewise juxtaposition above an underlying surface, comprising:

a first base and a separate companion base each having a plurality of corner support portions and a topside and a bottom side defining a predetermined thickness, said predetermined thickness of said first base being substantially identical to said predetermined thickness of said companion base;

each of said first base and said companion base having abutments projecting upwardly from said topside a predetermined height that is greater than or equal to said predetermined thickness, at least one of said abutments extending between each adjacent pair of corner support portions; and said first base having apertures extending transversely therethrough offset from said abutments for receiving said abutments of said companion base when said first base and companion base are matingly engaged.

2. A pedestal assembly according to claim 1, wherein said plurality of corner support portions includes four corner support portions defining four separate quadrants on of said base first and companion bases for supporting the corner portions of the decking elements, and wherein said abutments define the lateral spacing between each adjacent pair of quadrants.

3. A pedestal assembly according to claim 2, wherein first and second imaginary planes extend vertically through each of said first and companion bases in a crosswise pattern and define said quadrants, and wherein said abutments and apertures are arranged within said first and second planes.

4. A pedestal assembly according to claim 3, wherein said abutments are solid upstanding flanges and said apertures are elongate slots.

5. A pedestal assembly according to claim 4, wherein said flanges extending within said first plane are located closer to a center of said first base than said slots, and wherein said slots extending within said second plane are located closer to said center of said first base than said flanges.

6. A pedestal assembly according to claim 5, wherein said first base and said companion base are identical and can be stacked when said first plane of said first base is aligned with said second plane of said companion base.

7. A pedestal assembly according to claim 6, wherein said first and companion bases are made of plastic or rubber and include drainage apertures.

8. A stackable pedestal assembly for disposing corner edge portions of decking elements in edgewise juxtaposition above an underlying surface to form a deck, comprising:

at least a pair of separate substantially-identical pedestal bodies each having a topside with a surface portion and a bottom side;

each of said pedestal bodies having a predetermined thickness between said surface portion of said topside and said bottom side;

each of said pedestal bodies having a first pair of upstanding abutment surfaces projecting upwardly from said topside along a first axis extending across said topside and a second pair of abutment surfaces projecting upwardly from said topside along a second axis disposed orthogonal to said first axis;

said abutment surfaces of each of said pedestal bodies projecting above said topside a distance greater than said predetermined thickness;

said abutment surfaces being operable to engage the corner edge portions of decking elements when the decking elements are supported in edgewise juxtaposition on said surface portion of said topside;

each of said pedestal bodies having through apertures disposed orthogonal to said pairs of abutment surfaces for receiving said abutment surfaces of said other one of said pedestal bodies when one of said pedestal bodies is matingly engaged with the other;

whereby when like pedestal bodies are stacked in mating engagement, the abutment surfaces of a lower one of the pedestal bodies projects above the topside surface portion of an upper one of the pedestal bodies.

9. An assembly of fixed height stackable pedestals for supporting a plurality of corner portions of decking elements in edgewise juxtaposition above an underlying surface to form a deck, comprising:

at least a pair of substantially-identical fixed height pedestals each having a topside with corner support portions defined by intersecting first and second orthogonal lines of position;

each of said fixed height pedestals having a first pair of abutments with surfaces projecting upwardly from said topside in first spaced relation on said first line of position and a second pair of abutments having surfaces projecting upwardly from said topside in second spaced relation on said second line of position, each of said first and second pairs of abutments of each of said fixed height pedestals being of a height that is greater than or equal to a thickness of said fixed height pedestal;

said first pair of abutments of each of said fixed height pedestals being separated from one another on said first line of position a distance different from the spacing of said second pair of abutments on said second line of position; and each of said fixed height pedestals having through apertures on said first line of position and on said second line of position arranged to receive abutments of another one of said fixed height pedestals when said fixed height pedestals are matingly engaged with said first line of position of an upper one of said fixed height pedestals disposed orthogonal to said first line of position of said lower one of said fixed height pedestals.

10. A pedestal assembly for supporting corner portions of decking elements in edgewise juxtaposition above an underlying surface to form a deck, comprising:

a first base plate having a plurality of corner support portions, a topside, and a bottom side, said topside and bottom side defining a predetermined fixed height of said first base plate;

at least one upstanding abutment projecting integrally from said topside of said first base plate between a pair of said corner support portions of said first base plate, said upstanding abutment extending to a height above said topside of said first base plate that is greater than or equal to said predetermined fixed height of said first base plate; and a second separate base plate having a plurality of corner support portions, a topside, and a bottom side, said topside and bottom side of said second base plate defining a predetermined fixed height of said second base plate which is substantially identical to said predetermined fixed height of said first base plate;

said second base plate having at least one aperture extending transversely through said second base plate and forming openings in said topside and bottom side of said second base plate, said aperture being located between a pair of said corner support portions and being of a size for receiving said abutment of said first base plate.

11. A pedestal assembly according to claim 10, wherein said second base plate is removably stacked on said first base plate such that said corner support portions of said second base plate are aligned over said corner support portions of said first base plate and such that said upstanding abutment of said first base plate extends through said aperture of said second base plate and projects above said topside of said second base plate.

12. A pedestal assembly according to claim 11, wherein said first and second base plates are substantially identical and each has at least one of said abutments and at least one of said apertures.

13. A pedestal assembly according to claim 12, wherein each of said first and second base plates have four of said corner support portions defining four separate quadrants, and wherein at least one of said abutments and one of said apertures is provided between each pair of adjacent quadrants on said first and second base plates with said apertures being offset from said abutments.

14. A pedestal according to claim 13, wherein each of said first and second base plates have four of said pairs of adjacent quadrants, wherein said abutments and apertures between two of said pairs of adjacent quadrants are arranged such that said abutments are located closer to a center of said first and second base plates then said apertures, and wherein said abutments and apertures between the other two of said pairs of adjacent quadrants are arranged such that said apertures are located closer to a center of said first and second base plates then said abutments.

15. A pedestal according to claim 14, wherein said abutments are solid upstanding walls and said apertures are elongate slots.

16. A deck system for forming an elevated surface, comprising:

a plurality of decking elements in edgewise juxtaposition to form a deck, said decking elements having corner portions, and said deck including intersection areas in which said corner portions of adjacent decking elements extend; and a plurality of pedestals positioned directly beneath said intersection areas for supporting said corner portions a spaced distance above an underlying surface;

at least one of said pedestals including at least a pair of substantially-identical fixed height base plates each having a topside and a bottom side defining a predetermined fixed height therebetween;

each of said base plates having abutments projecting upwardly from said topside a predetermined distance that is greater than or equal to said predetermined fixed height of said base plate, each of said base plates having apertures extending transversely through said base plate offset from said abutments for receiving said abutments of the other of said fixed height base plates when said base plates are stacked together.

17. A deck system according to claim 16, wherein each of said pedestals includes at least one of said abutments extending between each adjacent pair of corner portions to define proper positioning and spacing between said adjacent decking elements to ensure that drainage passages extend between said adjacent decking elements and through said deck to the underlying surface.

18. A deck system according to claim 17, wherein first and second imaginary planes extend vertically through each of said base plates in a crosswise pattern and define quadrants on the base plate, wherein said abutments and apertures are arranged within said first and second planes.

19. A deck system according to claim 18, wherein said abutments are solid upstanding flanges and said apertures are elongate slots, wherein said flanges extending within said first plane are located closer to a center of each of said base plates than said slots, and wherein said slots extending within said second plane are located closer to said center of each of said base plates than said flanges.

* * * * *

UNITED STATES PATENT AND TRADEMARK OFFICE

CERTIFICATE OF CORRECTION

PATENT NO. : 7,386,955 B1
APPLICATION NO. : 11/559055
DATED : June 17, 2008
INVENTOR(S) : Repasky It is certified that error appears in the above-identified patent and that said Letters Patent is hereby corrected as shown below:

Column 6, line 67 “on of said base” should read --on each of said--

Signed and Sealed this

Second Day of September, 2008

JON W. DUDAS
*Director of the United States Patent and Trademark Office*